US006726451B2

(12) United States Patent
Frampton

(10) Patent No.: US 6,726,451 B2
(45) Date of Patent: Apr. 27, 2004

(54) CEILING FAN AND FAN BLADE MOUNTING ARRANGEMENT FOR GENERATING CENTER OR ROTATIONAL GRAVITY OUTSIDE VERTICAL AXIS

(76) Inventor: Thomas C. Frampton, E. 300 South, Zionsville, IN (US) 46077

( * ) Notice: Subject to any disclaimer, the term of this patent is extended or adjusted under 35 U.S.C. 154(b) by 0 days.

(21) Appl. No.: 10/041,375

(22) Filed: Jan. 8, 2002

(65) Prior Publication Data

US 2003/0129057 A1 Jul. 10, 2003

(51) Int. Cl.[7] ..... F04D 29/38

(52) U.S. Cl. ..... 416/5; 416/19; 416/144

(58) Field of Search ..... 416/5, 19, 144, 416/145, 214 R, 223 R, 241 B, 500

(56) References Cited

U.S. PATENT DOCUMENTS

| | | | |
|---|---|---|---|
| 2,079,044 | A | 5/1937 | Santmyer |
| 2,129,939 | A | 9/1938 | Juul |
| 2,837,301 | A | 6/1958 | Jenney |
| 3,693,910 | A | 9/1972 | Aldi |
| 4,132,360 | A | 1/1979 | Lee, Jr. |
| D306,643 | S | 3/1990 | Taylor, III |
| D309,183 | S | 7/1990 | Taylor, III |
| D313,467 | S | 1/1991 | Frampton |
| D325,436 | S | 4/1992 | Taylor, III |
| D325,778 | S | 4/1992 | Taylor, III |
| D326,149 | S | 5/1992 | Taylor, III |
| D329,285 | S | 9/1992 | Taylor, III |
| D329,286 | S | 9/1992 | Taylor, III |
| D329,896 | S | 9/1992 | Taylor, III |
| D336,513 | S | 6/1993 | Junkin et al. |
| D341,419 | S | 11/1993 | Taylor, III |
| 5,439,352 | A | 8/1995 | Line |
| 5,462,462 | A | 10/1995 | Woodley |
| D424,190 | S | 5/2000 | Tang |
| D432,640 | S | 10/2000 | Frampton |
| D433,118 | S | 10/2000 | Frampton |
| D433,119 | S | 10/2000 | Frampton |
| D433,498 | S | 11/2000 | Frampton |
| D433,747 | S | 11/2000 | Frampton |
| D433,748 | S | 11/2000 | Frampton |
| D433,749 | S | 11/2000 | Frampton |
| D434,134 | S | 11/2000 | Frampton |
| D437,047 | S | 1/2001 | Frampton |
| D437,406 | S | 2/2001 | Frampton |
| D438,610 | S | 3/2001 | Frampton |
| D438,950 | S | 3/2001 | Frampton |
| D443,926 | S | 6/2001 | Frampton |

(List continued on next page.)

FOREIGN PATENT DOCUMENTS

| | | |
|---|---|---|
| AU | 133424 A | 4/1998 |

OTHER PUBLICATIONS

Fanimation, "Unique Ceiling, Wall & Floor Mounted Fans," catalog, Jan. 1990, USA.

(List continued on next page.)

*Primary Examiner*—Edward K. Look
*Assistant Examiner*—Dwayne J. White
(74) *Attorney, Agent, or Firm*—Daniel L. Boots; Bingham McHale LLP

(57) ABSTRACT

A mounting arrangement for a ceiling fan has one or more blades located in the same semicircle of rotation so as to produce a center of rotational gravity that lies outside the vertical axis of the rotating fan. A ceiling fan has a counter balancing stabilizing member located in another semicircle of rotation to stabilize the rotating weight of the blade(s) so that during operation of the fan, the center of rotational gravity lies on the fan's axis. A single bladed ceiling fan has a blade with an elongated arcuate body that tapers from one end to its other end. A stabilizing member depends from the blade. There is an opening in the stabilizing member for creating drag when the blade rotates. A cover is provided for covering the opening.

40 Claims, 10 Drawing Sheets

U.S. PATENT DOCUMENTS

| | | | | | |
|---|---|---|---|---|---|
| D444,553 | S | | 7/2001 | Frampton | |
| 6,309,083 | B1 | * | 10/2001 | Lathrop et al. | 362/96 |
| D450,380 | S | | 11/2001 | Frampton | |
| D451,997 | S | | 12/2001 | Schwartz | |
| D454,192 | S | | 3/2002 | Frampton | |
| D454,634 | S | | 3/2002 | Frampton | |
| D454,635 | S | | 3/2002 | Frampton | |
| 6,352,407 | B2 | * | 3/2002 | Hill et al. | 416/144 |
| 6,428,188 | B1 | * | 8/2002 | Magno et al. | 362/362 |

OTHER PUBLICATIONS

Clem Labine's Traditional Building, "A Fan–tastic Ceiling Accessory," magazine article, Nov./Dec. 1997, USA.
Architectural Antiques—Andy Thornton, "Fan Systems," Catalog No. 12, First Edition, Mar. 1994, USA.
Gumps Mail Interiors, Plantation Ceiling Fan, catalog, Jul. 1998, USA.
The Sharper Image Home Collection, Plantation Ceiling Fan, catalog, Summer 1998, USA.
American Homestyle & Gardening, "The Islander Fan," magazine article, Aug./Sep. 1995, USA.
Metropolitan Home, "Three–Leaf Palm Fan by Fanimation," magazine article, Jul./Aug. 1998, USA.
A–Plus: Art/Antiques/Design—Cape Cod Edition, "Keep Your Cool," News Article, Jun. 1998, USA.
Friedes Associates, "1997 Hudson River Showhouse, New York," promotional piece, specific date unknown, USA.
Photograph—author unknown, Dec. 3, 1995, Raffles Hotel, Singapore.
Photograph—author unknown, circa 1905, White Rabbit Saloon, Tennessee.
Fanimation, "The Islander," promotional piece, date unknown, USA.
Fanimation, "The Palisade," promotional piece, date unknown, USA.
Winnower Fan Co. Inc., advertising brochure, p. 20, Ceilinig Fan A (received 3/86).
Fanimation, "Unique Ceiling, Wall & Floor Mounted Fans," catalog, Jan. 2000, USA.
Emerson, "Ceiling Fans Research & Development" catalog, Jan. 2001, USA.
Publication unknown, "The Rhinoceros Club," newspaper, date unknown, USA.
"Hampton Bay," promotional piece, date unknown, USA.
The Beacon, "Neon is a gas: local firm produces signs, architectural lighting," Newspaper Article, Aug. 1998, USA.
NICOR advertisement, Sep. 2000 issue, USA.
NICOR website: www.nicorlighting.com, Jul. 5, 2002, various ceiling fan photographs.
Regency Ceiling Fans, "Tropic Air" promotional piece brochure, Copyright 2001, USA.
Furniture Style, "Tahitian Ceiling Fan," magazine article, CONCORD product advertisement, Dec. 2001, USA.
Home Lighting & Accessories, "Vintage Crown Collection," magazine article, CONCORD product advertisement, Dec. 2001, USA.
Fanimation, "Unique Ceiling, Wall & Floor Fans," catalog, Jan. 2002, USA.
"Sycamore Ceiling Fan," promotional piece brochure, date unknown, US.

* cited by examiner

CEILING FAN AND FAN BLADE MOUNTING ARRANGEMENT FOR GENERATING CENTER OR ROTATIONAL GRAVITY OUTSIDE VERTICAL AXIS

BACKGROUND OF THE INVENTION

1. Field of the Invention

This invention relates to a ceiling fan and a ceiling fan blade mounting arrangement that produces a center of rotational gravity that lies outside the vertical axis of the rotating fan.

2. Discussion of Related Art

There are two methods of mounting blades to a ceiling fan so that the rotating weight of the fan is stabilized and the fan's center of rotational gravity lies within its vertical axis: (1) An even number of blades are mounted directly across from each other so the rotating weight of one blade is stabilized and matched by its complement; and (2) an even or odd number of blades may be "offset" so the sum of the blades' rotating weight is balanced. In each case, prior ceiling fans have more than one blade arranged in the circle of rotation so that the center of rotational gravity of the fan lies within the vertical axis. Thus, upon rotation, a single bladed ceiling fan generates a center of rotational gravity that lies outside the fan's vertical axis. Such an arrangement is perceived as non-functional and unconventional.

Likewise, a ceiling fan blade mounting arrangement where the blades are not spaced equally around the fan's housing so as to produce a center of rotational gravity that lies outside the vertical axis of the rotating fan is unconventional as well. The present invention addresses that need.

SUMMARY OF THE INVENTION

The present invention relates to a ceiling fan blade mounting arrangement that produces a center of rotational gravity that lies outside the vertical axis of the rotating fan compensated by a stabilizing member. One aspect of the invention includes a single bladed ceiling fan. In a preferred embodiment, the blade has a cross-section that progressively tapers from a leading edge to a trailing edge. The blade includes an elongated arcuate body that tapers from one end to the other and has at least a portion that is coincident with the fan's housing.

Another aspect of the invention regards a single bladed ceiling fan with a stabilizing member. The stabilizing member extends from the housing for stabilizing the rotating weight of the blade upon rotation of the fan. This embodiment may also utilize a blade that includes an elongated tapering arcuate body. In a preferred embodiment, this blade includes a hollow end with an opening and an opposite blade end. A cover is included for covering the opening. In a further preferred embodiment, the fan's housing includes an upper and a lower casing, and the lower casing is free to rotate relative to the upper casing.

Another aspect of the present invention regards a blade mounting arrangement that includes at least one additional fan blade extending from the housing and arranged in the same or opposite semicircle of rotation as the single blade. The stabilizing member is modified such that it stabilizes the rotating weight of the fan blades upon rotation of the fan so the center of rotational gravity of the fan lies on the fan's longitudinal axis accordingly. In a preferred embodiment, stabilizing members are provided stabilizing members, one corresponding to each of the fan's blades.

Another aspect of the present invention includes two or more blades spaced at various non-opposing positions in a radial fashion about the motor housing. This embodiment may include one or more stabilizing numbers arranged about and/or between or among the multiple blades so long as the center of rotational gravity lies on the vertical axis of the fan.

In a further preferred embodiment of the present invention the upper casing and/or the lower casing has an air duct formed in it. In another embodiment, at least one bore extends through the exterior surface of the upper casing for accommodating a light bulb socket. In that embodiment, a light bulb resides in the socket and provides illumination upwardly through the bore in the upper casing.

An object of the present invention is to provide a ceiling fan blade arrangement that generates a center of rotational gravity that lies outside the vertical axis of the fan when it rotates, but which may be compensated for by a stabilizing member.

Other objects and advantages will be apparent from the following description.

DESCRIPTION OF THE PREFERRED EMBODIMENT

Figure 1:
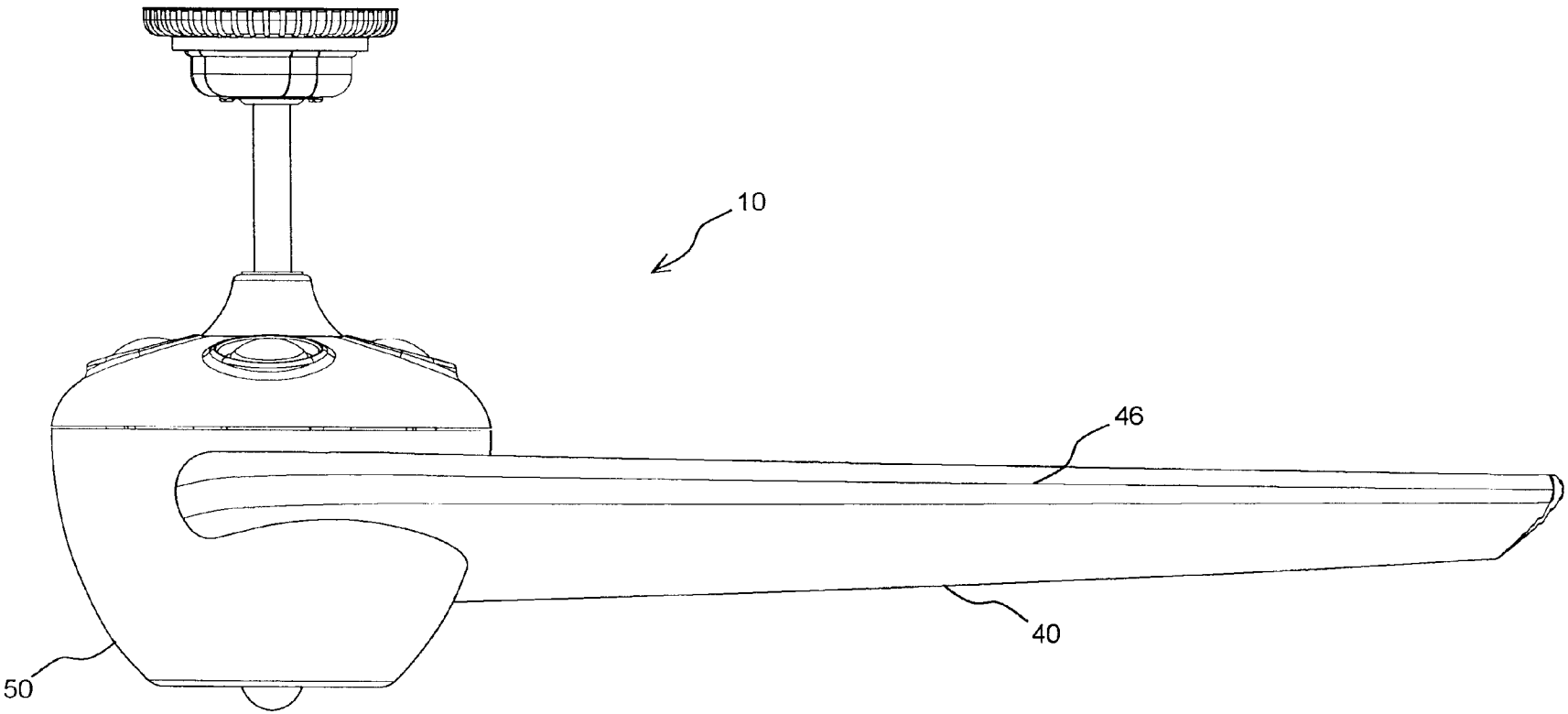
FIG. 1 is a perspective view of a single bladed ceiling fan of the invention.
Figure 2:
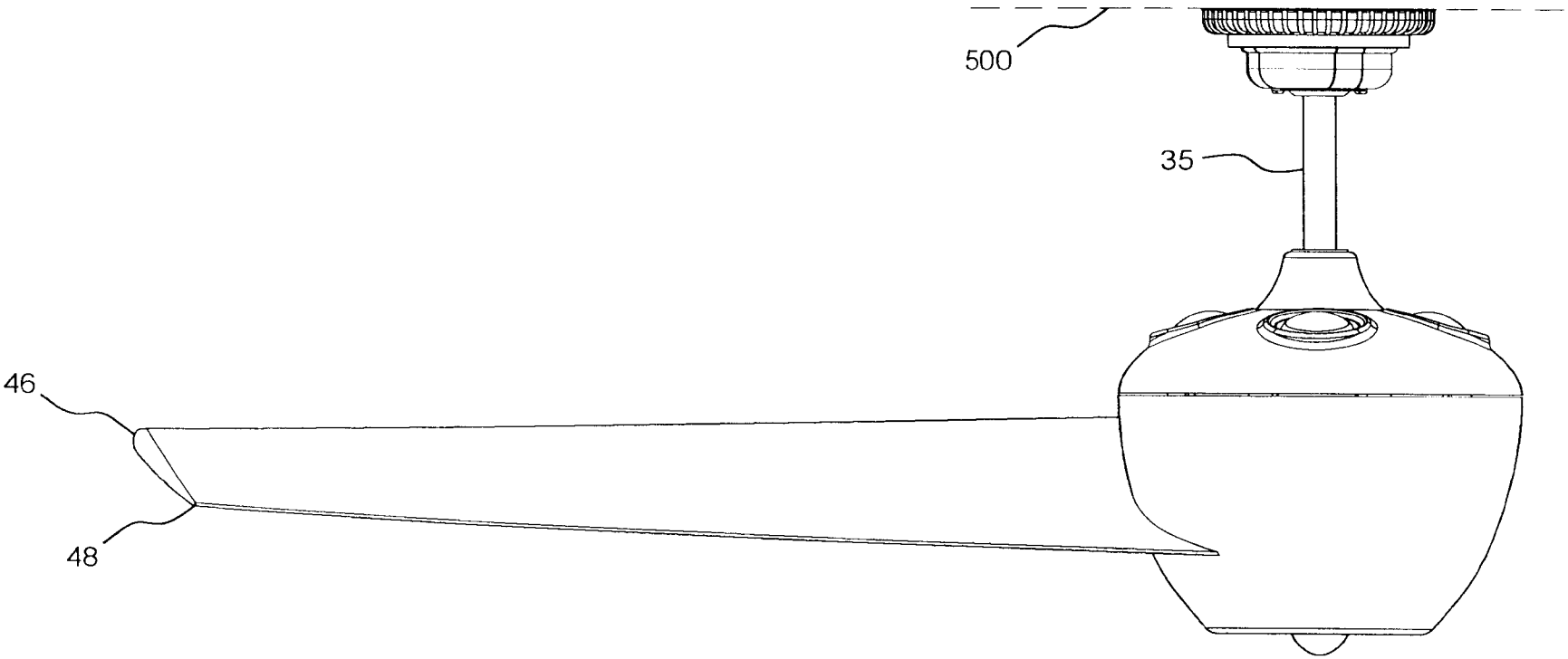
FIG. 2 is another view of the single bladed ceiling fan of FIG. 1.
Figure 3:
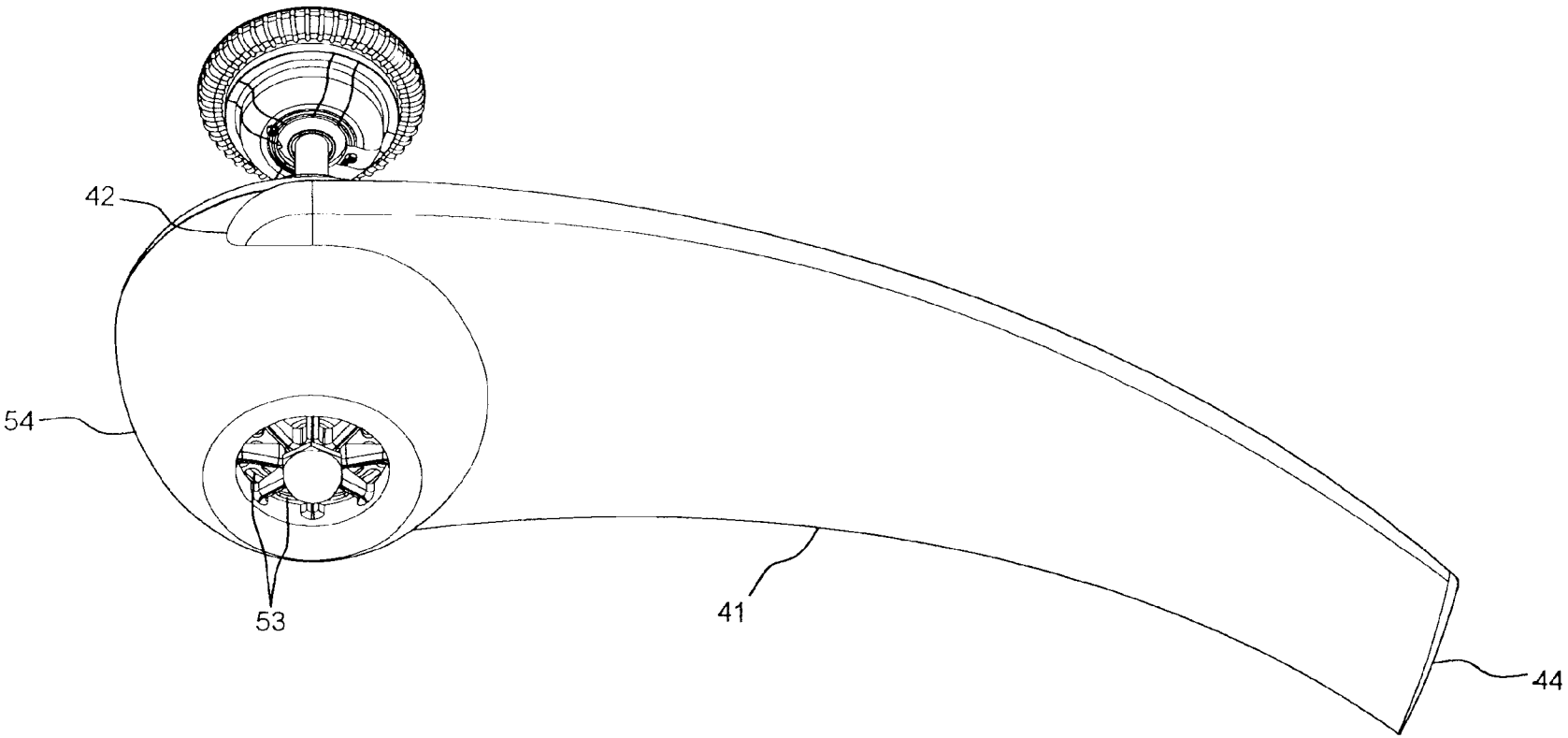
FIG. 3 is an elevated perspective view of another single bladed ceiling fan of the invention showing the arcuate body of the fan blade.

Ceiling fan blade arrangements according to the present invention are shown in FIGS. 1–9, wherein like elements are identified by like numerals. With reference to FIGS. 1–3, one preferred embodiment of the invention comprises a fan 10 including a single blade 40 extending radially from a central motor housing 50. Blade 40 may be connected to the fan directly or indirectly with extension hardware known in the art. Blade 40 can be formed from wood, wicker, plastic or organic matter, such as palm leaves, for example, which materials are known in the art. Of course, materials that have mechanical and physical properties rendering them better suited for the ceiling fans of the invention are preferred. Plastic, wood, metal and such rigid materials are more preferred.

In one embodiment, blade 40 has an elongated arcuate body 41 that tapers from a proximal end 42 to its opposing distal end 44. In an embodiment, blade 40 has a cross-section that progressively tapers from a leading edge 46 to a trailing edge 48. Such a fan would experience out-of-concentric rotation if not provided with some element to equal the balance of the fan or if the fan was not securely anchored in the ceiling at 500 via down rod 35, as shown in FIG. 2.

Figure 4:
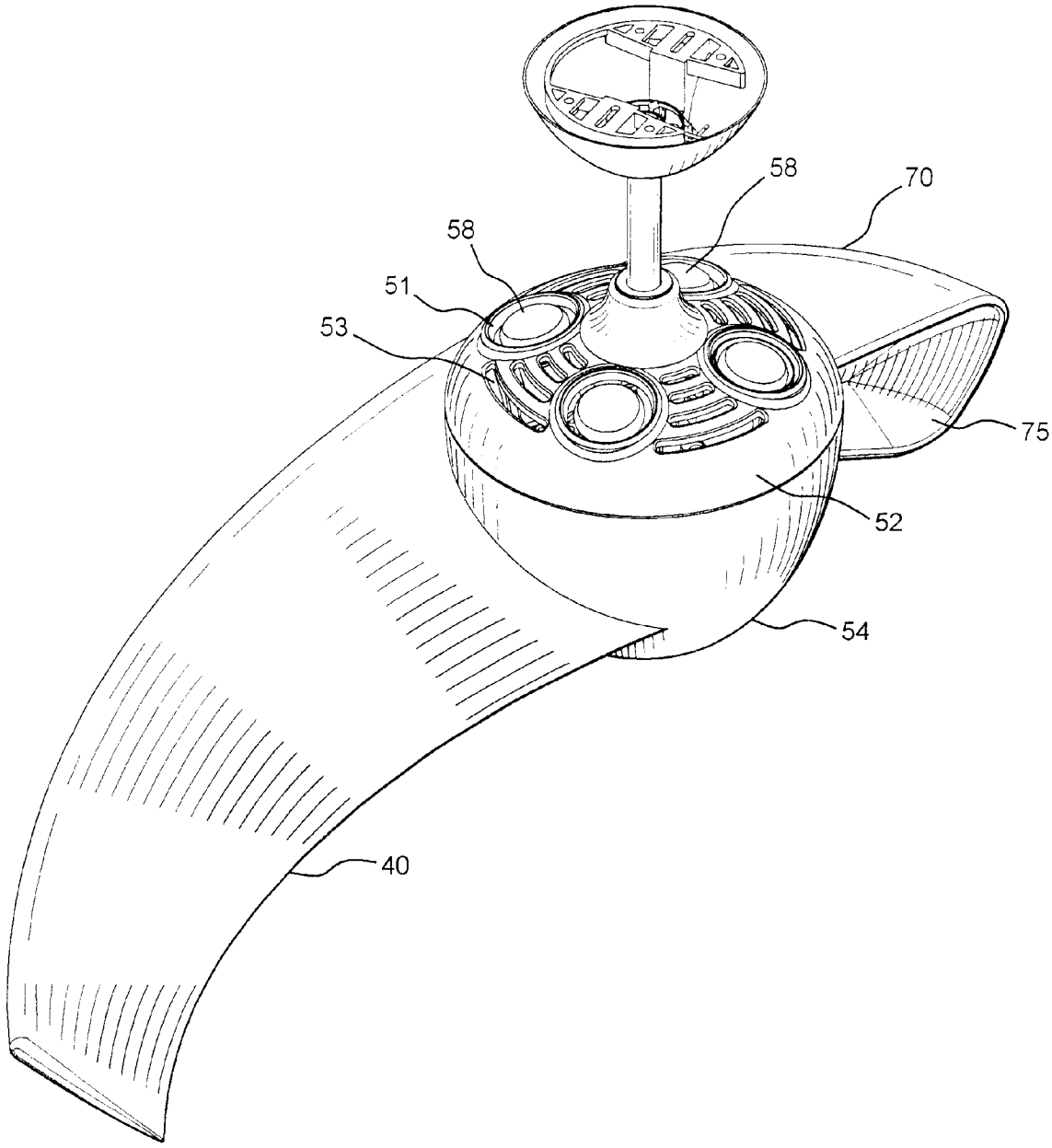
FIG. 4 is an elevated perspective view of still another single bladed ceiling fan of the invention showing the stabilizing member.
Figure 5:
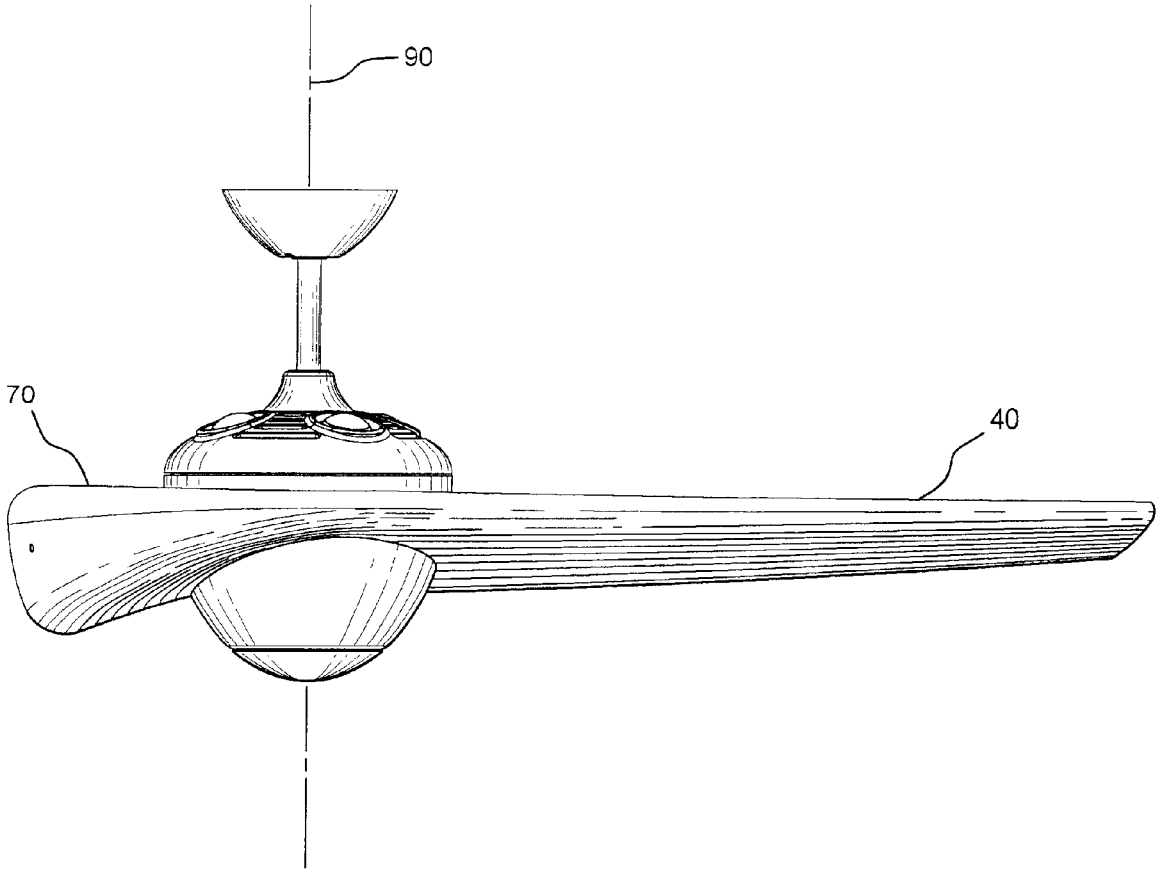
FIG. 5 is another view of the single bladed fan of FIG. 4.
Figure 6:
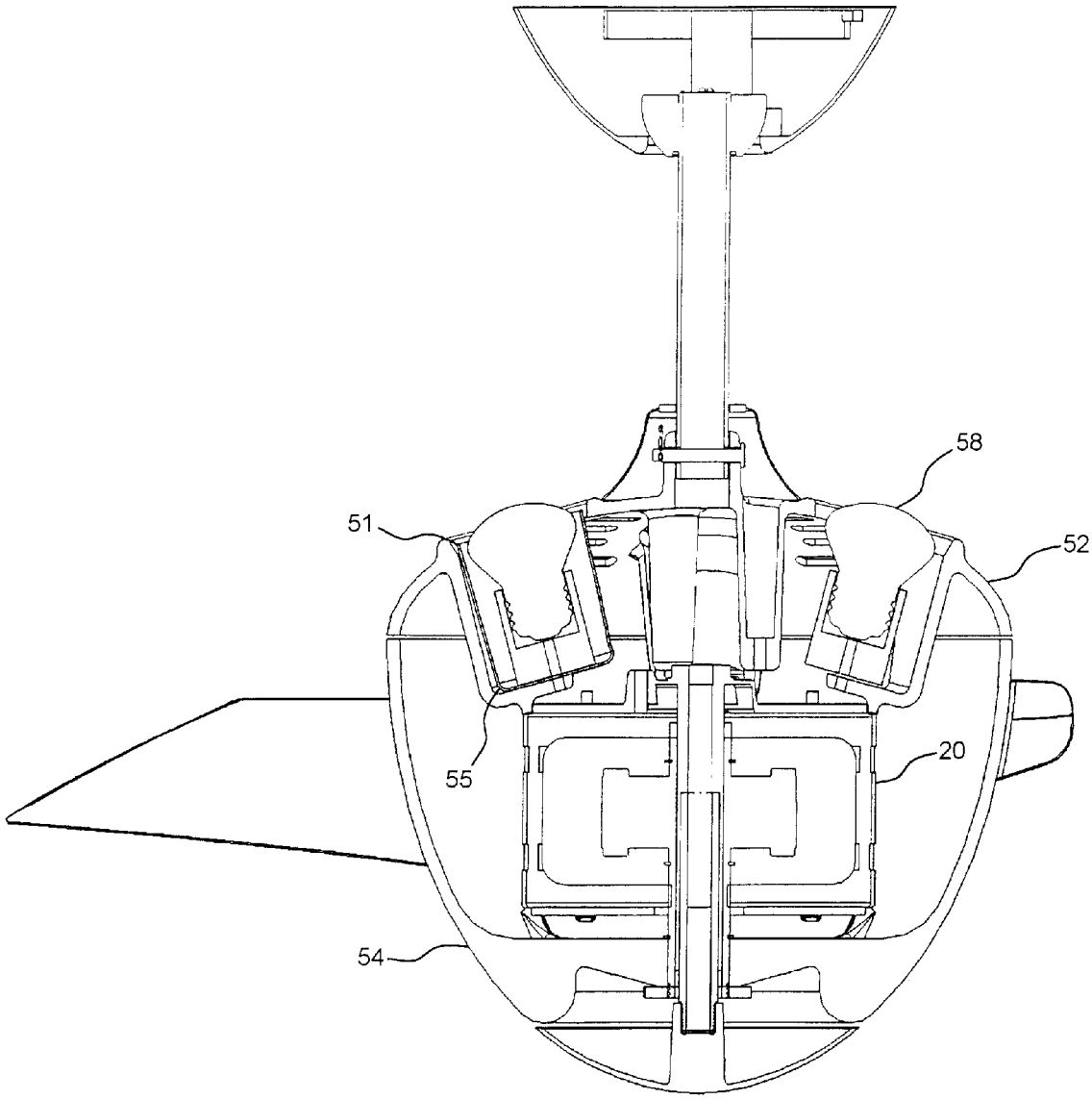
FIG. 6 is a cross-sectional perspective view of the upper and lower casings of the housing showing the bore, light bulb socket and light bulb contained in the housing.

In another preferred embodiment shown in FIGS. 4–6, a stabilizing member 70 is provided adjacent to the motor housing 50 opposite the single blade 40. As shown in FIG. 5, stabilizing member 70 has a thickness considerably greater than that of the opposing blade 40. Stabilizing member 70 performs two functions: (1) it stabilizes the rotating weight of the fan such that its center of rotational gravity lies within the vertical axis 90 of the fan; and (2) it equalizes the air or wind resistance or "drag" of blade 40. The greater thickness of stabilizing member 70 addresses the first concern, while opening 75 provides drag that approximates that generated by opposing blade 40. If desired, opening 75 may be enlarged or modified to form an air tunnel or "scoop" (not shown) in stabilizing member 70 to catch and direct air to and through the motor housing 50 to assist in cooling the electric drive motor during operation. Cover 80 is provided to cover opening 75, which provides other aeronautic variables that may be desirable.

Motor housing 50 can be provided with air ducts 53 in its upper casing 52 and/or lower casing 54, as shown in FIGS. 3 and 4. Air ducts 53 help cool motor 20, which helps prolong the life of the fan motor. With reference to FIG. 6, upper casing 52 includes bores 51 for accommodating light bulb socket 55 in which resides light bulb 58. Light bulb(s) 58 provide illumination upwardly through bore 51.

Figure 7:
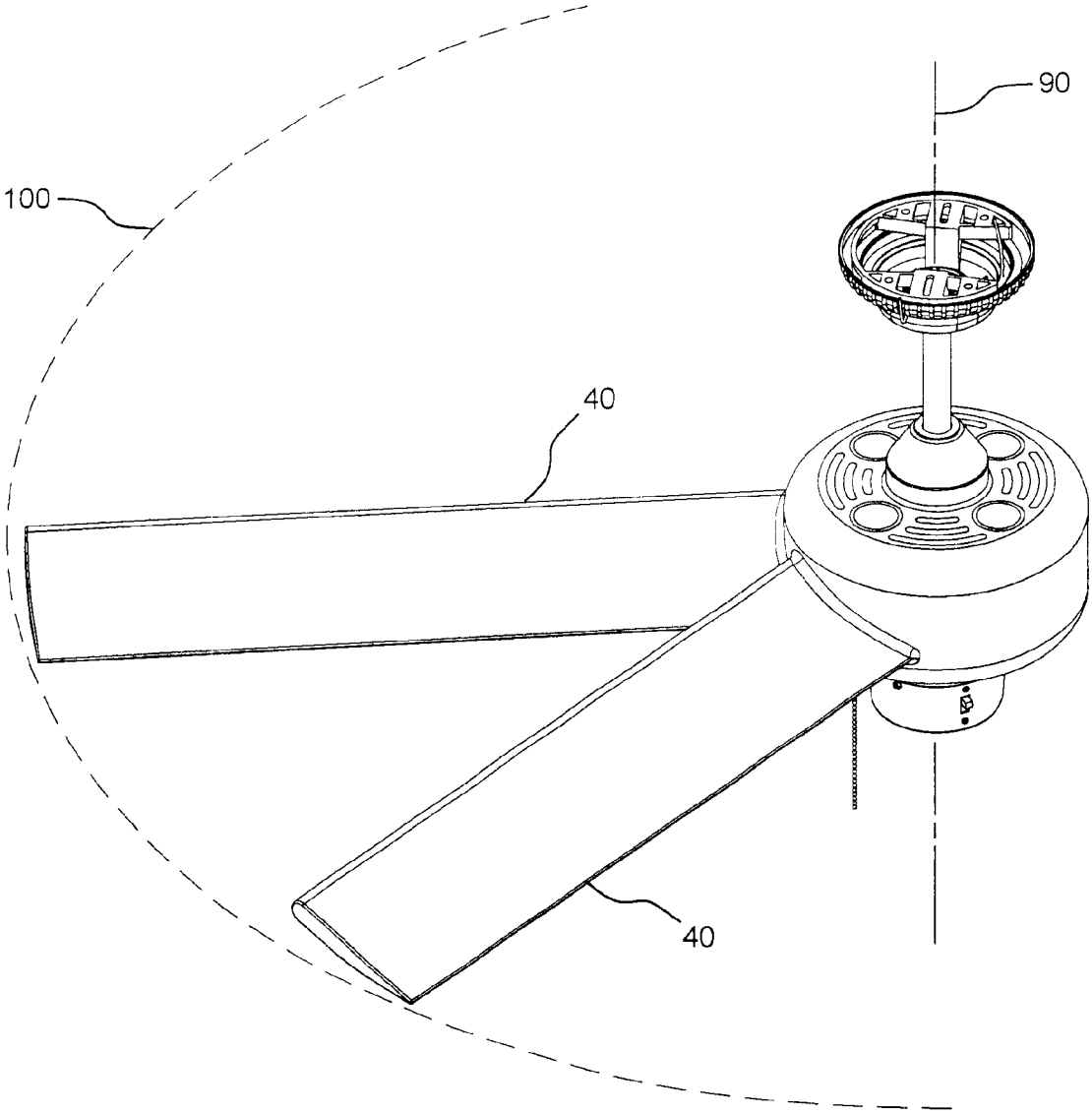
FIG. 7 is an elevated perspective view showing a ceiling fan blade mounting arrangement of the invention.
Figure 8:
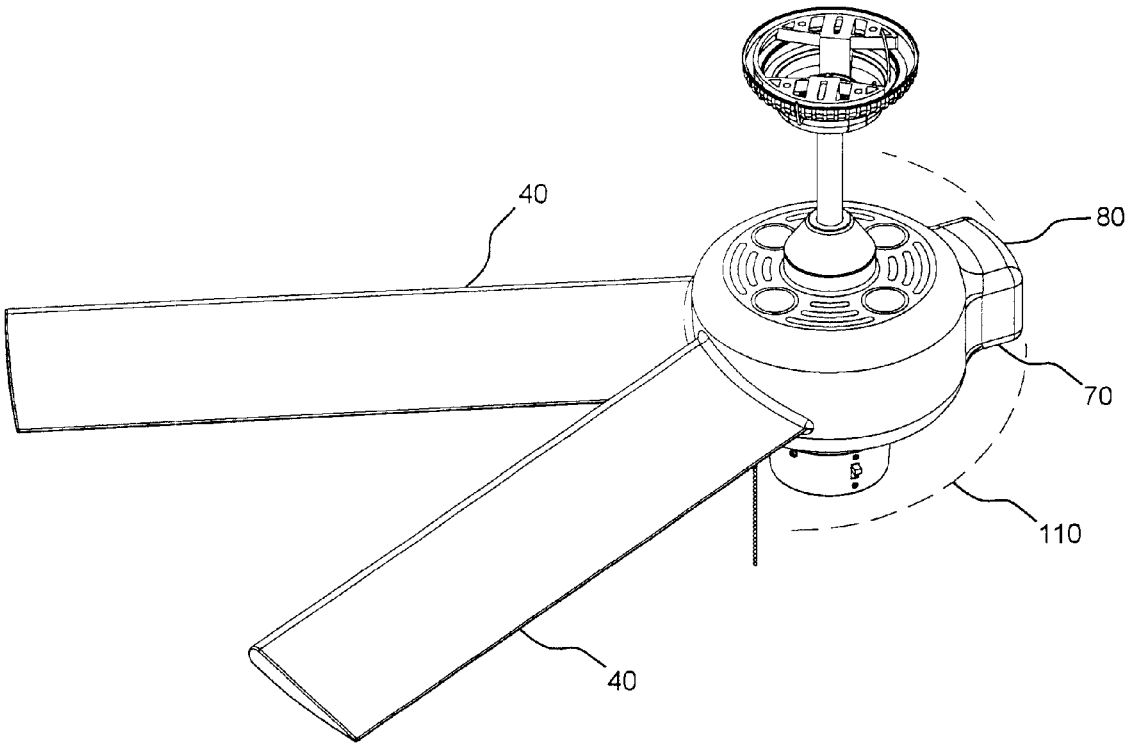
FIG. 8 is an elevated perspective view showing another fan blade mounting arrangement of the invention showing the stabilizing member and cover.
Figure 9:
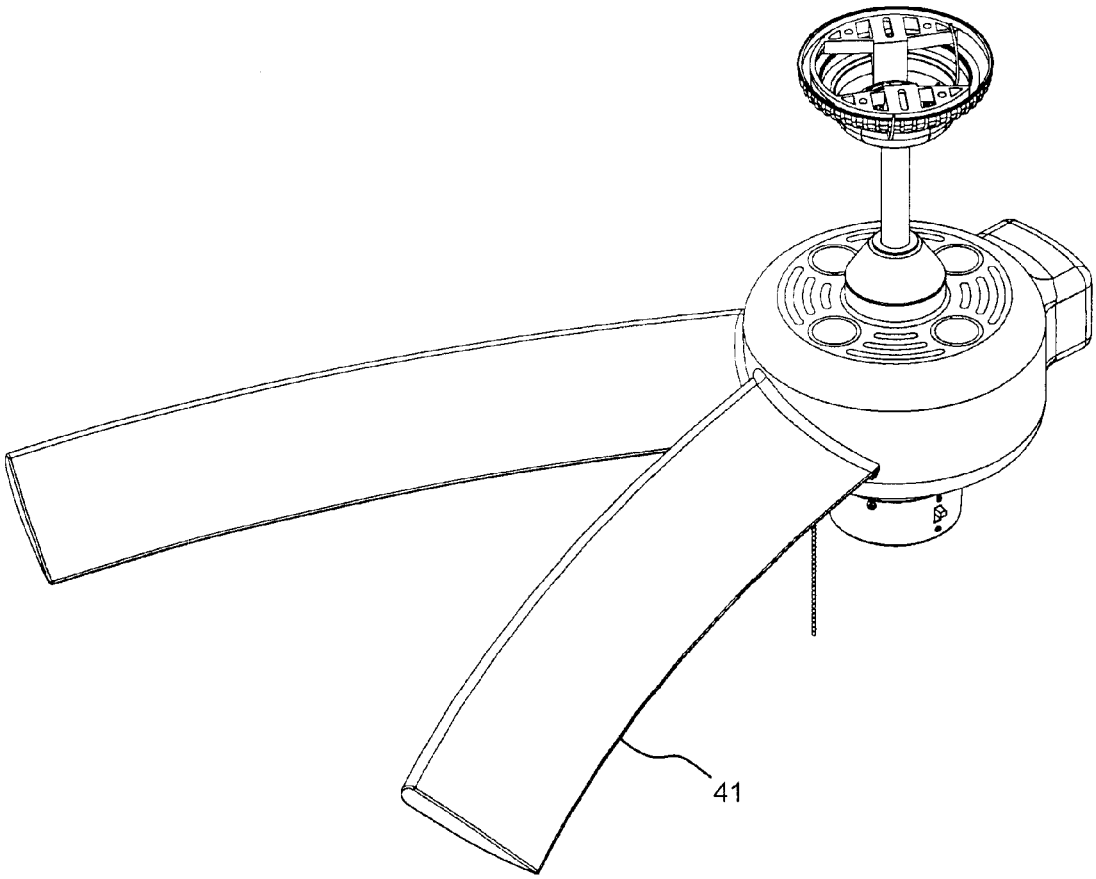
FIG. 9 is an elevated perspective view showing another blade mounting arrangement illustrating the arcuate body of the fan blade, the stabilizing member and cover.

With respect to FIGS. 7–9, in yet a further embodiment, fan 10 includes at least two fan blades 40 connected for rotation, arranged adjacent to each other in one semicircle of rotation 100. Stabilizing member 70 extends from fan 10 in a second semicircle of rotation 110 so that stabilizing member 70 stabilizes the rotating weight of the blades 40 on rotation so that the center of rotational gravity of the fan lies on longitudinal axis 90.

Figure 10:
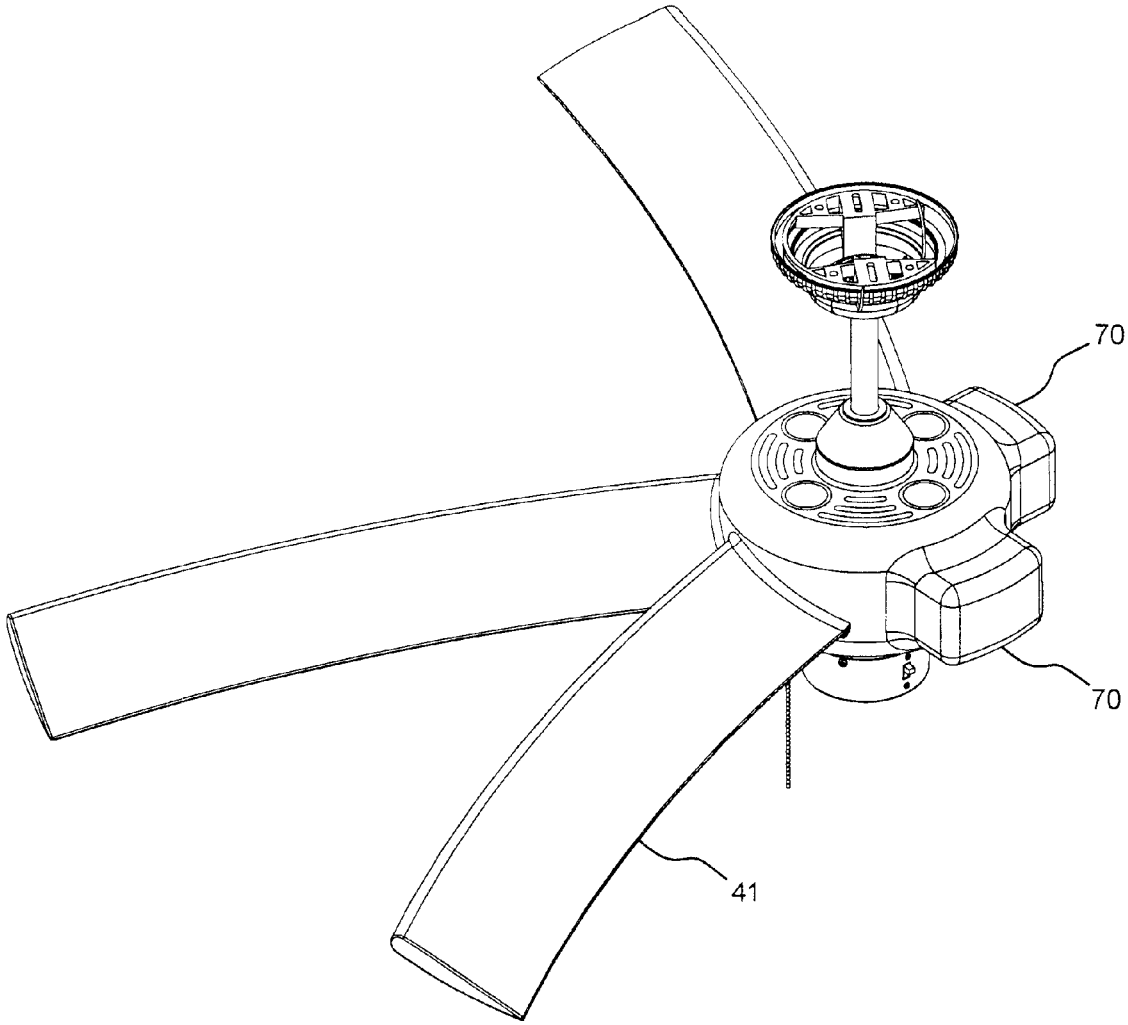
FIG. 10 is an elevated perspective view showing another blade mounting arrangement illustrating the stabilizing members arranged about and between the multiple blades.

Yet another embodiment includes two or more blades spaced at various non-opposing positions in a radial fashion about the motor housing. Along those same lines, such a fan could include one or more stabilizing members 70 arranged about and/or between or among the multiple blades so long as the center of rotational gravity lies on the vertical axis 90 of fan 10, as shown in FIG. 10.

Alternatively, if the multi-bladed fan of this invention is sufficiently anchored at the ceiling portion 500 and the downrod 35 is of sufficient strength, fan 10 need not have stabilizing member 70 and should withstand the torque and out-of-concentric forces generated by the rotation of a single blade 40 or two or more non-opposing blades.

Although the ceiling fan and mounting arrangement provided by the present invention have been described with a preferred embodiment, those skilled in the art will understand that modifications, variations and combinations may be made without departing from the scope of this invention as set forth in the following Claims. Such modifications, variations, and combinations are considered to be within the purview and scope of the appended Claims. For example, the fan blade arrangement of FIG. 4 could be modified to include cover 80 for covering opening 75, and bores 51 that accommodate light bulbs 58 could be omitted. Likewise, stabilizing member(s) 70 can be altered or omitted accordingly. The blade arrangements of FIGS. 4, 8, and 9 may differ from each other so long as the rotating weight of fan 10 is stabilized and the fan's center of rotational gravity lies within the fan's vertical axis 90. As noted however, alternatively, if the fan of this invention is sufficiently anchored at the ceiling portion 500 and the downrod 35 is of sufficient strength, fan 10 need not have stabilizing member 70 and should withstand the torque and out-of-concentric forces generated by the rotation of a single blade 40 or two or more non-opposing blades, as shown in FIGS. 1, 2, 3, 6 and 7.

While a preferred embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A single bladed ceiling fan comprising a motor, a rotatable shaft connected to the motor, a motor housing supported by said shaft, said housing having an exterior surface, and a fan blade extending from said housing, wherein at least a portion of said fan blade is coincident with said housing.

2. A single bladed ceiling fan comprising a motor, a rotatable shaft connected to the motor, a motor housing supported by said shaft, said housing having an exterior surface, and a fan blade extending from said housing, wherein at least a portion of said fan blade is coincident with said housing, wherein said fan blade has a cross-section that progressively tapers from a leading edge to a trailing edge.

3. The single bladed ceiling fan of claim 2 wherein said blade further comprising an elongated arcuate body that tapers from one end to its other end.

4. A single bladed ceiling fan comprising a motor, a rotatable shaft connected to the motor, a motor housing supported by said shaft, said housing having an exterior surface, and a fan blade extending from said housing, wherein at least a portion of said fan blade is coincident with said housing, wherein said housing further comprises an upper casing and a lower casing, wherein said lower casing is free to rotate about an axis relative to said upper casing.

5. The single bladed ceiling fan of claim 4 wherein said blade further comprising an elongated arcuate body that tapers from one end to its other end.

6. The single bladed ceiling fan of claim 5 wherein said upper casing has an air duct formed therein.

7. The single bladed ceiling fan of claim 5 wherein said lower casing has an air duct formed therein.

8. The single bladed ceiling fan of claim 6 further comprising at least one bore extending through the exterior surface of said upper casing for accommodating a light bulb socket in which resides a light bulb, wherein said light bulb is contained substantially within said housing and provides illumination upwardly through said bore.

9. The single bladed ceiling fan of claim 7 further comprising at least one bore extending through the exterior surface of said upper casing for accommodating a light bulb socket in which resides a light bulb, wherein said light bulb is contained substantially within said housing and provides illumination upwardly through said bore.

10. The single bladed ceiling fan of claim 9 wherein said upper casing has an air duct formed therein.

11. A single bladed ceiling fan comprising a motor, a rotatable shaft connected to the motor, a motor housing supported by said shaft, a fan blade extending from said housing, and stabilizing means extending from said housing for stabilizing the rotating weight of said blade upon rotation of said fan, wherein said stabilizing means depends from said fan blade.

12. The single bladed ceiling fan of claim 11 wherein said fan blade and said housing are coincident.

13. The single bladed ceiling fan of claim 11 wherein said blade further comprising an elongated arcuate body having a hollow end with an opening and an opposite blade end.

14. The single bladed ceiling fan of claim 13 further comprising a cover for covering said opening.

15. The single bladed ceiling fan of claim 14 wherein said fan blade has a leading edge that progressively tapers from said hollow end to said blade end.

16. The single bladed ceiling fan of claim 13 wherein said fan blade and said housing are coincident, and said hollow end and said blade end extend from generally opposing sides of said housing.

17. The single bladed ceiling fan of claim 16 wherein said fan blade has a leading edge that progressively tapers from said hollow end to said blade end.

18. A blade mounting arrangement for a ceiling fan of the type that typically includes a downrod for supporting the fan from the ceiling, a motor, a rotatable shaft connected to the motor so that the motor can turn the shaft about the shaft's longitudinal axis, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least one fan blade connected for rotation to the fan and extending in one semicircle of rotation, wherein upon rotation of said fan, a center of rotational gravity is produced which lies outside the vertical axis of the rotating fan.

19. The blade mounting arrangement of claim 18 further comprising a plurality of fan blades connected for rotation to the fan and extending from said fan in said one semicircle of rotation, wherein said stabilizing member stabilizes the rotating weight of said plurality of fan blades upon rotation of said fan such that the center of rotational gravity of said fan lies on the longitudinal axis of the shaft.

20. The blade mounting arrangement of claim 15 further comprising a stabilizing member extending from said fan in a second semicircle of rotation relative to said at least one single fan blade, wherein said stabilizing member stabilizes the rotating weight of said fan blade upon rotation of said fan such that the center of rotational gravity of said fan lies on the longitudinal axis of the shaft.

21. The blade mounting arrangement of claim 20 further comprising a second fan blade connected for rotation to the fan and extending from said fan and arranged in said one semicircle of rotation, wherein said stabilizing member stabilizes the rotating weight of said at least one and said second fan blades upon rotation of said fan such that the center of rotational gravity of said fan lies on the longitudinal axis of the shaft.

22. The blade mounting arrangement of claim 21 further comprising at least two stabilizing members extending from said shaft in said second semicircle of rotation, wherein said at least two stabilizing members stabilize the rotating weight of said at least two fan blades upon rotation of said fan such that the center of rotational gravity of said fan lies on the longitudinal axis of the shaft.

23. The blade mounting arrangement of claim 21 further comprising a motor housing supported by the shaft, said housing has an upper casing and a lower casing, wherein said lower casing is free to rotate about said longitudinal axis relative to said upper casing.

24. The blade mounting arrangement of claim 23 wherein said upper casing has an air duct formed therein.

25. The blade mounting arrangement of claim 24 further comprising at least one bore extending through the exterior surface of said upper casing for accommodating a light bulb socket in which resides a light bulb, wherein said light bulb is contained substantially within said housing and provides illumination upwardly through said bore.

26. The blade mounting arrangement of claim 23 wherein said lowering has an air duct formed therein.

27. The blade mounting arrangement of claim 26 further comprising at least one bore extending through the exterior surface of said upper casing for accommodating a light bulb socket in which resides a light bulb, wherein said light bulb is contained substantially within said housing and provides illumination upwardly through said bore.

28. A blade mounting arrangement for a ceiling fan of the type that typically includes a downrod for supporting the fan from the ceiling, a motor, a rotatable shaft connected to the motor so that the motor can turn the shaft about the shaft's longitudinal axis, a motor housing supported by the shaft, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades connected for rotation to the fan and extending in one semicircle of rotation;

a stabilizing member extending from said fan in a second semicircle of rotation relative to said at least two fan blades, wherein said stabilizing member stabilizes the rotating weight of said blades upon rotation of said fan such that the center of rotational gravity of said fan lies on the longitudinal axis of the shaft; and, said at least two fan blades further comprising an elongated arcuate body that tapers from one end to the other.

29. The blade mounting arrangement of claim 28 wherein each of said at least two fan blades has a cross-section that progressively tapers from a leading edge to a trailing edge.

30. The blade mounting arrangement of claim 29 wherein each of said at least two blades further comprising an elongated arcuate body that tapers from one end to its other end.

31. The blade mounting arrangement of claim 28 further comprising a motor housing supported by the shaft, said housing having an upper casing and a lower casing, wherein said lower casing is free to rotate about said longitudinal axis relative to said upper casing.

32. The blade mounting arrangement of claim 31 wherein each of said at least two blades further comprising an elongated arcuate body that tapers from one end to its other end.

33. The blade mounting arrangement of claim 32 wherein said upper casing has an air duct formed therein.

34. The blade mounting arrangement of claim 32 wherein said lower casing has an air duct formed therein.

35. The blade mounting arrangement of claim 33 further comprising at least one bore extending through the exterior surface of said upper casing for accommodating a light bulb socket in which resides a light bulb, wherein said light bulb is contained substantially within said housing and provides illumination upwardly through said bore.

36. The blade mounting arrangement of claim 34 further comprising at least one bore extending through the exterior surface of said upper casing for accommodating a light bulb socket in which resides a light bulb, wherein said light bulb is contained substantially within said housing and provides illumination upwardly through said bore.

37. The blade mounting arrangement of claim 36 wherein said upper casing has an air duct formed therein.

38. A single bladed ceiling fan comprising a motor, a rotatable shaft connected to the motor, a motor housing supported by said shaft, said housing having an exterior surface, and a fan blade extending from said housing, wherein at least a portion of said fan blade is coincident with said housing, wherein said blade further comprising an elongated arcuate body that tapers from one end to its other end.

39. A blade mounting arrangement for a ceiling fan of the type that typically includes a downrod for supporting the fan from the ceiling, a motor, a rotatable shaft connected to the motor so that the motor can turn the shaft about the shaft's longitudinal axis, a motor housing supported by the shaft, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades connected for rotation to the fan and extending in one semicircle of rotation;

a stabilizing member extending from said fan in a second semicircle of rotation relative to said at least two fan blades, wherein said stabilizing member stabilizes the rotating weight of said blades upon rotation of said fan such that the center of rotational gravity of said fan lies on the longitudinal axis of the shaft; and, said at least two fan blades having a cross-section that progressively tapers from a leading edge to a trailing edge.

40. A blade mounting arrangement for a ceiling fan of the type that typically includes a downrod for supporting the fan from the ceiling, a motor, a rotatable shaft connected to the motor so that the motor can turn the shaft about the shaft's longitudinal axis, a motor housing supported by the shaft, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades connected for rotation to the fan and extending in one semicircle of rotation;

a stabilizing member extending from said fan in a second semicircle of rotation relative to said at least two fan blades, wherein said stabilizing member stabilizes the rotating weight of said blades upon rotation of said fan such that the center of rotational gravity of said fan lies on the longitudinal axis of the shaft; and, a motor housing supported by the shaft, said housing having an upper casing and a lower casing, wherein said lower casing is free to rotate about said longitudinal axis relative to said upper casing.

* * * * *